US009791144B2

(12) United States Patent
Molina-Fernandez

(10) Patent No.: US 9,791,144 B2
(45) Date of Patent: Oct. 17, 2017

(54) INDOOR HOLIDAY LIGHTS

(71) Applicant: Adelso Molina-Fernandez, Huntington Station, NY (US)

(72) Inventor: Adelso Molina-Fernandez, Huntington Station, NY (US)

( * ) Notice: Subject to any disclaimer, the term of this patent is extended or adjusted under 35 U.S.C. 154(b) by 214 days.

(21) Appl. No.: 14/258,794

(22) Filed: Apr. 22, 2014

(65) Prior Publication Data

US 2014/0313707 A1 Oct. 23, 2014

Related U.S. Application Data

(60) Provisional application No. 61/814,364, filed on Apr. 22, 2013.

(51) Int. Cl.

| | |
|---|---|
| ***F21V 33/00*** | (2006.01) |
| ***G09F 9/00*** | (2006.01) |
| ***F21S 4/10*** | (2016.01) |
| *A47G 33/08* | (2006.01) |

(52) U.S. Cl.

CPC ..... *F21V 33/0028* (2013.01); *A47G 33/08* (2013.01); *F21S 4/10* (2016.01); *F21V 33/0032* (2013.01); *G09F 9/00* (2013.01); *A47G 2033/0827* (2013.01)

(58) Field of Classification Search

CPC .... F21V 33/0028; F21V 33/0032; G09F 9/00; G09F 13/00; G09F 17/00; G09F 19/02; G09F 19/14; F21W 2121/00; F21W 2121/04; F21S 4/001; F21S 9/022; F21S 6/00; F21S 4/10; F21Y 2101/02; G09G 5/38; A44C 15/00; A44C 15/0015; A44C 25/00; A47G 2033/0827; A47G 33/08; Y10S 362/812; B44C 5/00; A41D 1/002; A41D 27/08; A47H 13/04; B44F 7/00; B60R 13/005; D04D 7/10; F21K 9/52; G02B 6/0068; G02B 6/0073; G02F 1/1336; G06F 3/14

See application file for complete search history.

(56) References Cited

U.S. PATENT DOCUMENTS

| | | | | |
|---|---|---|---|---|
| 8,511,877 | B2 * | 8/2013 | Chien | H04N 7/181 362/249.02 |
| 2004/0085258 | A1 * | 5/2004 | Piccionelli | 345/2.1 |
| 2008/0264816 | A1 * | 10/2008 | Yeh | B44C 5/00 206/316.2 |
| 2010/0002451 | A1 * | 1/2010 | Reynolds | 362/363 |
| 2013/0286636 | A1 * | 10/2013 | Martin | 362/123 |

* cited by examiner

*Primary Examiner* — Stephen F Husar

(74) *Attorney, Agent, or Firm* — Ruth Eure; Emery L. Tracy

(57) ABSTRACT

Indoor holiday lights comprising a strand of lights and ornaments wherein the ornaments comprise a specially designed picture frame inside of which the user can insert a favorite photograph or other printed image, wherein the picture frame is positioned on the surface of an ornament. Also provided is a strand of holiday lights further comprising an electronic scrolling banner that displays any number of holiday messages and offerings of good tidings and cheer options positioned below the frame.

6 Claims, 2 Drawing Sheets

INDOOR HOLIDAY LIGHTS

CLAIM OF PRIORITY

This patent application claims priority under 35 USC 119 (e) (1) from U.S. Provisional Patent Application Ser. No. 61/814,364 filed Apr. 22, 2013, of common inventorship herewith entitled, "Indoor Holiday Lights."

BACKGROUND OF THE INVENTION

Field of the Invention

This invention relates generally to indoor holiday lights and, more particularly, the invention relates to indoor holiday lights providing specially designed holiday lights and ornaments, with each adorned with a dazzling, electronic display screen that emits a scrolling message of holiday cheer.

Description of the Prior Art

Perhaps the most recognizable symbol of Christmas is the Christmas tree. The tradition of bringing trees into the home to celebrate the Christmas season dates back over one thousand years, to Great Britain. In early Christian times, families joined together to "bring in the Yule log," a large trunk of an evergreen that was placed in the fireplace and burned for the twelve days of Christmas. Spread throughout Europe and eventually to North America, this practice was the precursor for the modern Christmas tree that is enjoyed today. A Christmas tree provides a beautiful means of decorating the home for the holiday season. Brightly lit and adorned with a variety of ornaments, that range from elegant hand blown glass bulbs, to charming homemade decorations made by children and passed down through generations, a lovingly decorated Christmas tree brings joy to the young and old alike.

DETAILED DESCRIPTION OF THE PREFERRED EMBODIMENTS

As illustrated in FIGS. 1-6, the present invention is indoor holiday lights providing specially designed holiday lights and ornaments, with each adorned with a dazzling, electronic display screen that emits a scrolling message of holiday cheer.

Figures 1, 5, 6:
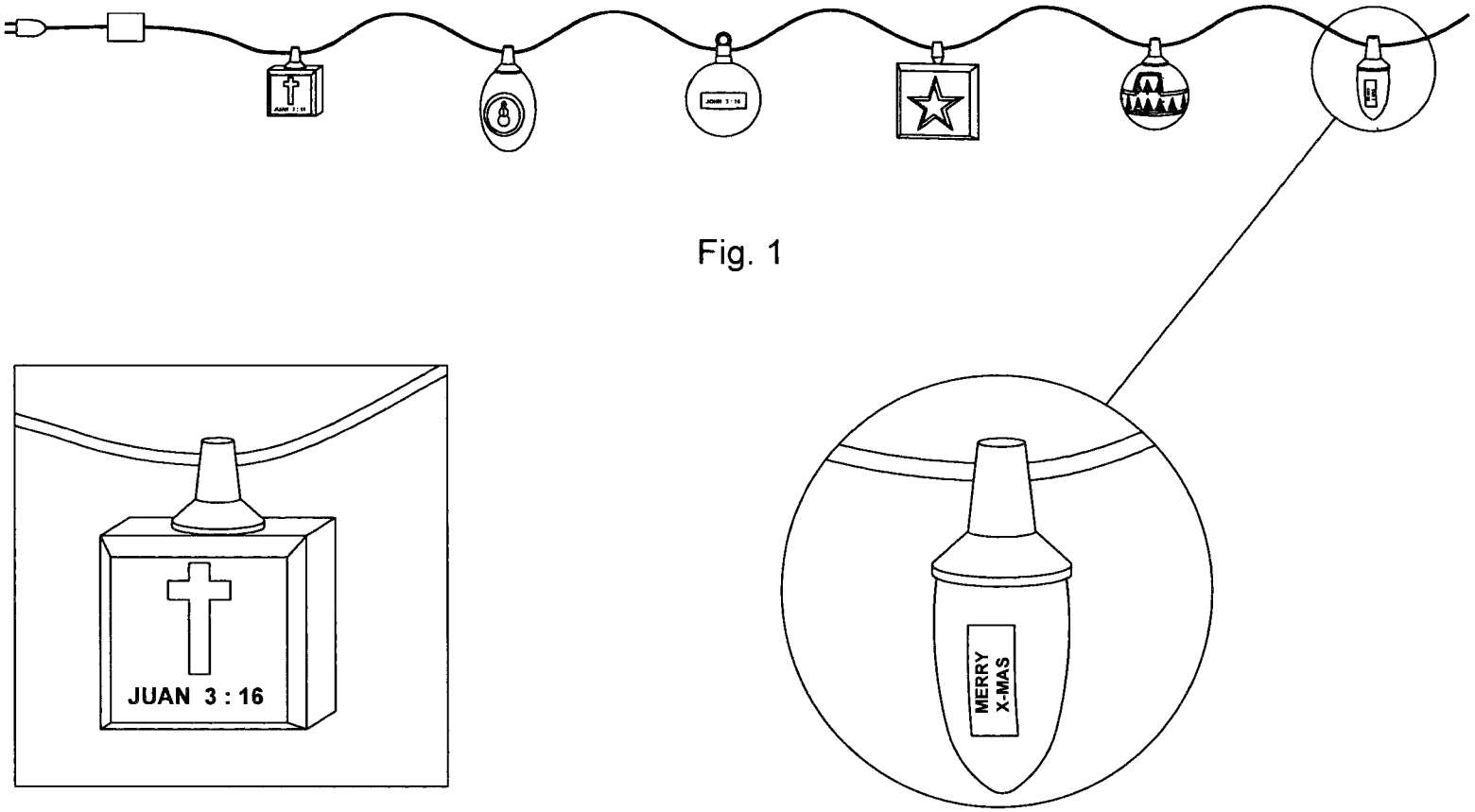
FIGS. 1-6 are perspective views illustrating indoor holiday lights, constructed in accordance with the present invention.

FIG. 1 shows a strand of six lights, each light being encased by a different holiday ornament.

Figure 2:
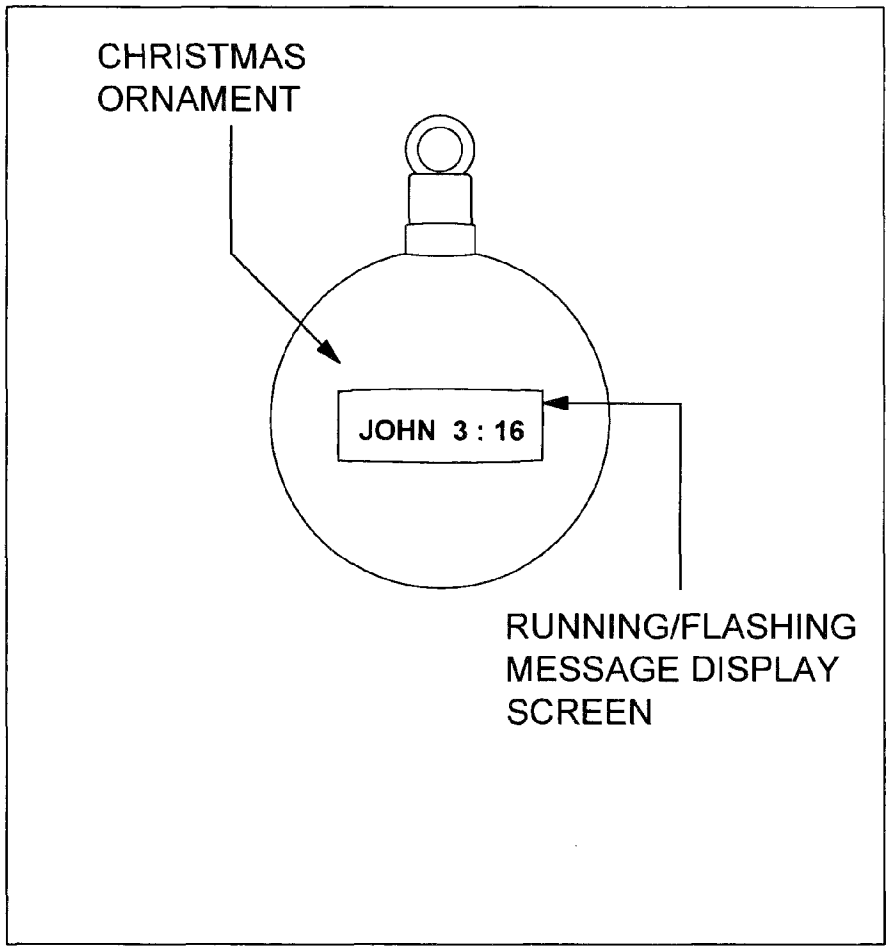

FIG. 2 is a close up view of an essentially spherical ornament showing a scrolling bible verse as a running/flashing message display on a small screen embedded into or mounted onto the side of the ornament.

Figure 3:
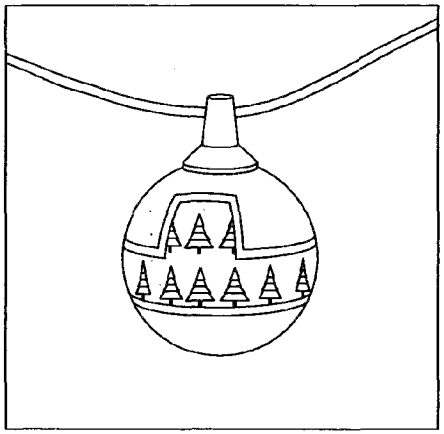

FIG. 3 is a close up view of an ornament having scrolling Christmas trees pass through a window on the side of the ornament.

Figure 4:
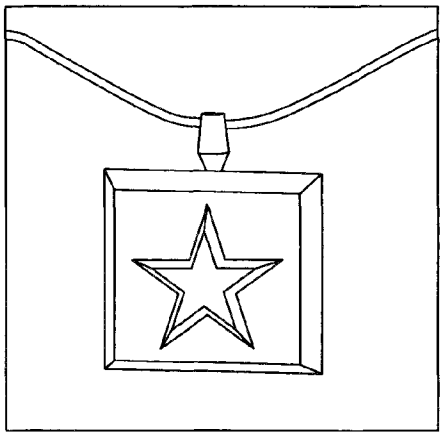

FIG. 4 is a close up view of an ornament having a star. This star can flash or change color.

FIG. 5 is a close up vie of a scare ornament showing a cross and a bible verse.

FIG. 6 is a tear drop shaped ornament showing the message "Merry Xmas."

The indoor holiday lights of the present invention are similar in function to traditional holiday lights and thus can be manufactured primarily of heavy duty weather resistant plastic wire which encases the electric wire components. Both clear and multi colored light strands can be offered in Indoor Holiday Lights. This set of lights can be produced in a variety of lengths to accommodate various decorating needs, with the lights themselves featuring large, shatter-proof bulbs on which the actual scrolling electronic display is featured. As with traditional holiday lights, one end of the light strand features a standard size extension plug while the opposite features a two-prong power plug. The ornaments can be produced in a variety of shapes including traditional round spherical bulbs, elongated oval bulbs, tear drop shaped bulbs and tree shaped or snowflake shaped ornaments, to name a few options. In addition, these decorative ornaments can be produced in a range of sizes and colors to meet various decorating needs. Positioned at the top of the ornament is a sturdy hook fastener for use in hanging the ornament on the tree, or on other decorative displays. The ornament itself can be manufactured primarily of shatter-proof plastic material, while more delicate glass versions could also be made available. The ornaments can be mounted on top of the bulb, or mounted next to the bulb on the strand. The strand can also incorporate bulbs by themselves, or bulbs with ornaments mounted onto the bulb, or a combination of both bulbs and ornamnents. As used herein the terms "light," "bulb" and "ornament" are meant to include any configuration of bulb or ornament, alone or in combination.

Positioned on the surface of each light and/or ornament in the indoor holiday lights is a specially designed picture frame inside of which the user can insert a favorite photograph or other printed image. This frame can also be pre-filled with decorative images germane to the winter holiday season including Santa Claus, snowmen, angels and winter landscapes, to name a few options. Positioned directly below this image is an electronic scrolling banner that displays any number of holiday messages and offerings of good tidings and cheer. These illuminated messages range from the standard, "Merry Christmas" and "Happy New Year" to messages that detail and celebrate the true meaning of the Christmas holiday season. The messages can be offered in a variety of languages including English, Spanish and Chinese, as well as languages of various countries throughout the world. This scrolling display can be preprogrammed with a specific sentiment, or can be configured to be personalized and programmed by the user. The display can be a continuous feed, or periodically flash, adding a bit of whimsy to the overall look. This unique display screen is powered by way of an internally contained battery housed within the base of the unit. The light strands can be sold as a single strand of lights, while ornaments from the line are offered in sets of four units per container.

Use of the indoor holiday lights of the present invention is very simple and straight forward. First, the user purchases a set of holiday lights or ornaments as desired for use in decorating their home for the holidays. Once purchased the user fills the included picture frames located on the front of the bulbs and ornaments with a favorite photograph or printed image. Alternately, the user may choose to display the holiday image already featured on the unit. The user then displays these decorative ornaments and lights as desired throughout the home. For instance, one may choose to suspend the light strand across a mantelpiece, while ornaments could be carefully hung on the actual Christmas tree. With the lights and ornaments properly displayed, the user activates the scrolling displays and enjoys the charming messages displayed on each. The control for the display can be by means of a switch on each ornament, a switch on the entire strand, or by remote control which can selectively activate the ornaments such as in sequence, or in unison, for example. After the holiday season has passed, the lights are carefully stored away along with other Christmas decorations, or if desired by the user, the ornaments can be placed on an upright ornament stand for year-round enjoyment.

The indoor holiday lights of the present invention offer users a number of significant benefits and advantages. Foremost, the Christmas lights provide holiday revelers truly distinct and personalized decorations for use in holiday decorating. Beautifully crafted holiday lights and ornaments adorned with personalized photographs and an illuminated scrolling message of good tidings and cheer, the lights provide a unique means of customizing one's holiday display. Allowing holiday revelers to celebrate their family, friends and other loved ones through beautiful and unique lights and ornaments, the lights prove a favorite addition to any Christmas tree, holiday swag or wreath. While the Christmas light strand can be utilized inside or outside the home to beautifully decorate an expansive area, the actual ornaments provide a more personal approach. A beautiful gift, an ornament, handpicked to represent the personality and interests of the recipient and displaying a personalize scrolling message proves a thoughtful and generous token to be shared at birthday parties, anniversary gatherings and especially during the holidays. Lending a unique and striking touch to any holiday decor, the Christmas lights prove a favorite accessory during the Christmas holidays.

The indoor holiday lights of the present invention offer users a striking and unique means of decorating their homes for the holidays. An entire line of lights and ornaments that are customized with personal photographs and adorned with scrolling electronic messages, these dazzling decorations offer users an effective means of proudly displaying cherished memories.

The foregoing exemplary descriptions and the illustrative preferred embodiments of the present invention have been explained in the drawings and described in detail, with varying modifications and alternative embodiments being taught. While the invention has been so shown, described and illustrated, it should be understood by those skilled in the art that equivalent changes in form and detail may be made therein without departing from the true spirit and scope of the invention, and that the scope of the present invention is to be limited only to the claims except as precluded by the prior art. Moreover, the invention as disclosed herein may be suitably practiced in the absence of the specific elements which are disclosed herein.

What is claimed is:

1. Indoor holiday lights comprising:

a strand of holiday lights, each of the holiday lights having a surface; and a scrolling electronic message display mounted or embedded onto the surface of at least one of the holiday lights;

wherein the message is displayed directly onto the surface of the holiday lights.

2. The indoor holiday lights of claim 1 wherein the scrolling electronic display is mounted or embedded on each of the lights.

3. The indoor holiday lights of claim 1 and further comprising:

a picture frame on each of the lights inside of which the user can insert a favorite photograph or other printed image, wherein the picture frame is positioned on the surface of the respective light.

4. The indoor holiday lights of claim 1 wherein the electronic scrolling display displays any number of holiday messages and offerings of good tidings and cheer options positioned below the frame.

5. The indoor holiday lights of claim 1 wherein the scrolling display can be preprogrammed with a specific sentiment, or can be configured to be personalized and programmed by the user.

6. The indoor holiday lights of claim 1 wherein the scrolling display can be a continuous feed, or periodically flash.

* * * * *